US005370064A

United States Patent [19]

Sgabellone

[11] Patent Number: 5,370,064

[45] Date of Patent: Dec. 6, 1994

[54] TRAVEL TABLE

[76] Inventor: Tony Sgabellone, 4 Collingwood Cr., Kanata, Ontario K2K 2G6, Canada

[21] Appl. No.: 145,607

[22] Filed: Nov. 4, 1993

[30] Foreign Application Priority Data

Aug. 5, 1993 [CA] Canada ..... 2,101,954

[51] Int. Cl.[5] ..... A47B 3/00

[52] U.S. Cl. ..... 108/162; 108/165; 108/157

[58] Field of Search ..... 108/162, 165, 157; 312/259, 284; 211/135, 72, 73

[56] References Cited

U.S. PATENT DOCUMENTS

| | | | |
|---|---|---|---|
| 1,776,071 | 9/1930 | Horwath | 108/157 |
| 2,240,024 | 4/1941 | Stone et al. . | |
| 2,808,191 | 10/1957 | Cramer . | |
| 3,244,125 | 4/1966 | Mackey . | |
| 3,438,345 | 4/1969 | Lasaine et al. . | |
| 3,729,244 | 4/1973 | Butler | 108/157 X |
| 3,804,031 | 4/1974 | Pitts . | |
| 3,821,936 | 7/1974 | Morse . | |
| 3,870,390 | 3/1975 | Herrmann | 108/153 X |
| 4,138,951 | 2/1979 | Nelson | 108/157 X |
| 4,429,932 | 2/1984 | Brennan | 312/259 |
| 4,632,345 | 12/1986 | Barley | 312/259 X |
| 4,770,107 | 9/1988 | Miller . | |
| 4,819,568 | 4/1989 | Coffrin . | |
| 4,940,003 | 7/1990 | Mayhew et al. . | |
| 5,081,936 | 1/1992 | Drieling . | |
| 5,096,274 | 3/1992 | Fuschetto et al. | 312/284 |
| 5,127,339 | 7/1992 | Hood, Jr. . | |
| 5,140,914 | 8/1992 | Bohbot et al. . | |
| 5,289,784 | 3/1994 | Waibel | 108/157 |

FOREIGN PATENT DOCUMENTS

| | | |
|---|---|---|
| 710224 | 5/1965 | Canada . |
| 1114882 | 12/1981 | Canada . |
| 2043338 | 8/1991 | Canada . |

*Primary Examiner*—José V. Chen

*Attorney, Agent, or Firm*—Stevens, Davis, Miller & Mosher

[57] ABSTRACT

A folding table is disclosed for use as an auxiliary table for a child or an adult. It is comprised of three modules, each assembled from a blank of cardboard and easily placed in a flat state for storage or disposal. Each of the leg modules (11, 12) is channel shaped and defines an outwardly projecting tongue which is compatible with a passage of the channel shaped top module (10). A plurality of tear lines (34, 33, 32) is provided in the top module for selective adjustment of the width of the table by tearing off the outer part of the panel. A similar system of tear lines (51*c*, 51*b*, 51*a*) allows the tearing off of the sections of the leg modules to selectively adjust the height of the table to match, for instance, the height of a child seat in a car. The table may be provided with a utensil tray fixedly but releasably secured to the top module (10).

12 Claims, 5 Drawing Sheets

TRAVEL TABLE

The present invention relates to folding or collapsible tables made from sheet material such as paper board. Folding tables of the above type have been known for many years and are primarily used for short term applications such as during an extended car trip but they can also be used as bed tables etc. Known folding tables of this type are disclosed, for instance, in U.S. Pat. Nos. 2,240,024, 3,438,345 or 5,127,339.

In general terms, the folding table of the type to which the present invention pertains has to meet several requirements. It has to be inexpensive to produce. It has to provide a reasonably large area on the top of the table for the user while requiring as little as possible space around the user. This is particularly important when the table is used in combination with a child's seat in a car where another person or persons have to sit beside the user of the table.

Another desirable feature of a folding table is that the table be easily adjustable in height and in width. It will be appreciated that when the table is used with a child's seat in a car, the width of the table may be substantially narrower than that of a table used for a patient or as a beach table.

U.S. Pat. Nos. 2,240,024 A. W. Stone et al. and 3,438,345 Laseine et al. present each a single piece collapsible table which meets the requirement of low production costs but which does not provide quick adjustability of the height or width of the table. Also, it occupies relatively large space due to the triangular cross-section of the leg modules of the table. The space saving arrangement is more pronounced in U.S. Pat. No. 5,127,339 (Hood Jr.) but this latter arrangement has the disadvantage that it is designed to rest on the user's lap which is not always feasible for applications such as keeping a child occupied during an extended car trip.

It is an object of the present invention to advance the art of folding tables by avoiding or at least reducing the disadvantages of known prior art referred to above.

In general terms, the present invention provides for use in making the top module of the table of claim 1, an integral blank, comprising, in combination: a rectangular top panel section defined by two opposed end edges and two opposed first side fold lines; a pair of opposed rectangular exterior flange sections, each hinged to the top panel section at the respective first side fold line; a pair of opposed, rectangular support sections, each support section hinged to the respective one of said exterior flange sections along a second fold line parallel with the first fold line; a plurality of first locking tabs extending transversely away from an outer margin of each support section; a plurality of first locking cutouts in said top panel section, said first locking cutouts being compatible with said first locking tabs and being disposed along and in general coincidence with the respective first fold line; said exterior flange sections and said support sections being of a generally identical width whereby, on assembly, they define a slot-shaped passage therebetween; and a plurality of transverse tear lines extending across the entire blank from one side thereof to the other.

The invention will be described by way of a preferred embodiment with reference to the accompanying diagrammatic, not to scale drawings wherein.

As mentioned above, the drawings are not to scale, particularly with respect to the thickness of the sheet material from which the blank is made, in order to facilitate the understanding of structural features of the table.

Figure 1:
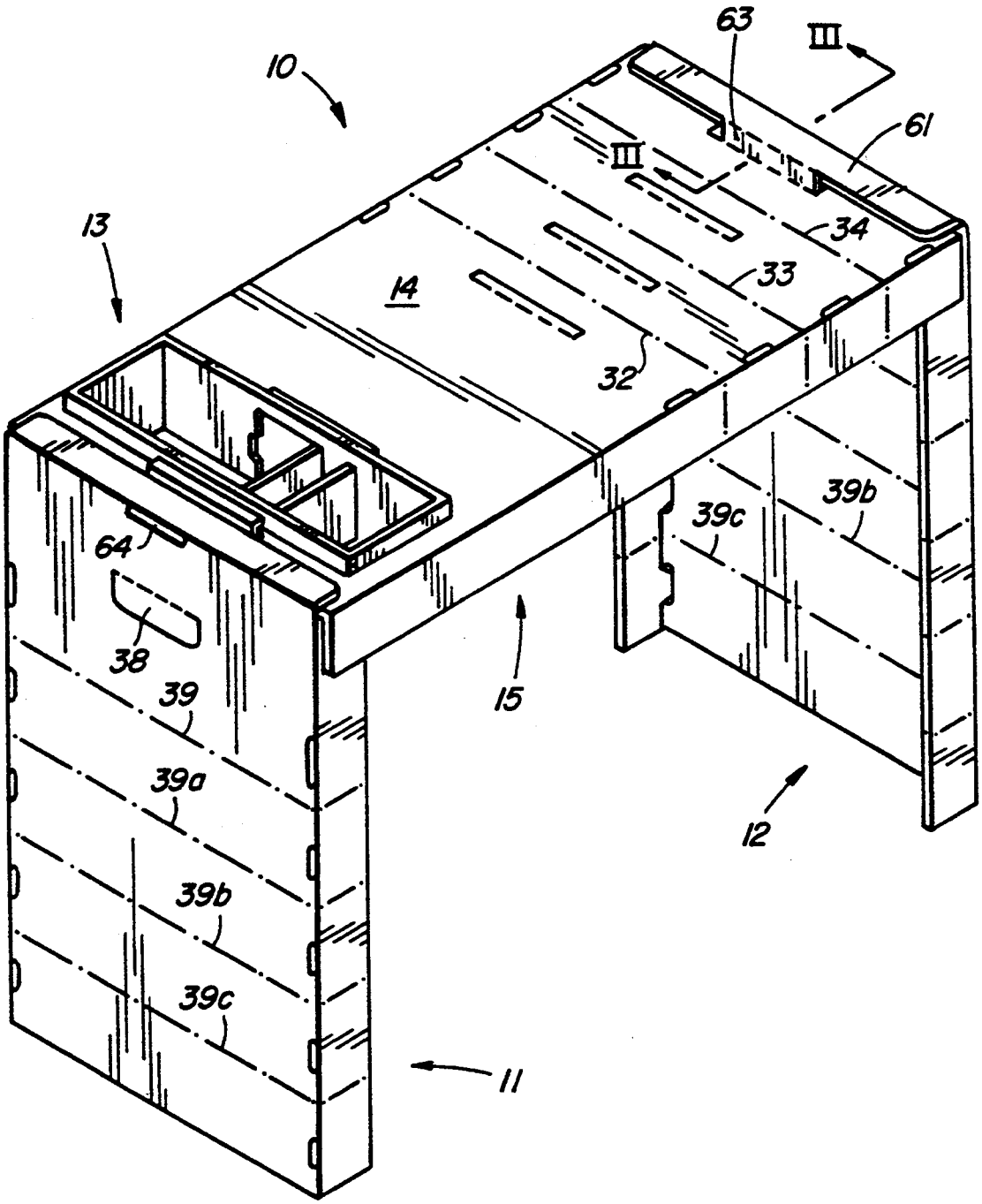
FIG. 1 is a diagrammatic top perspective view of the table in an assembled state.

Turning firstly to FIG. 1, and in general terms, the table of the present invention comprises a top module 10, a first leg module 11 and second leg module 12. If desired, a utensil container 13 may also be inserted in the top module 10.

Figure 4:
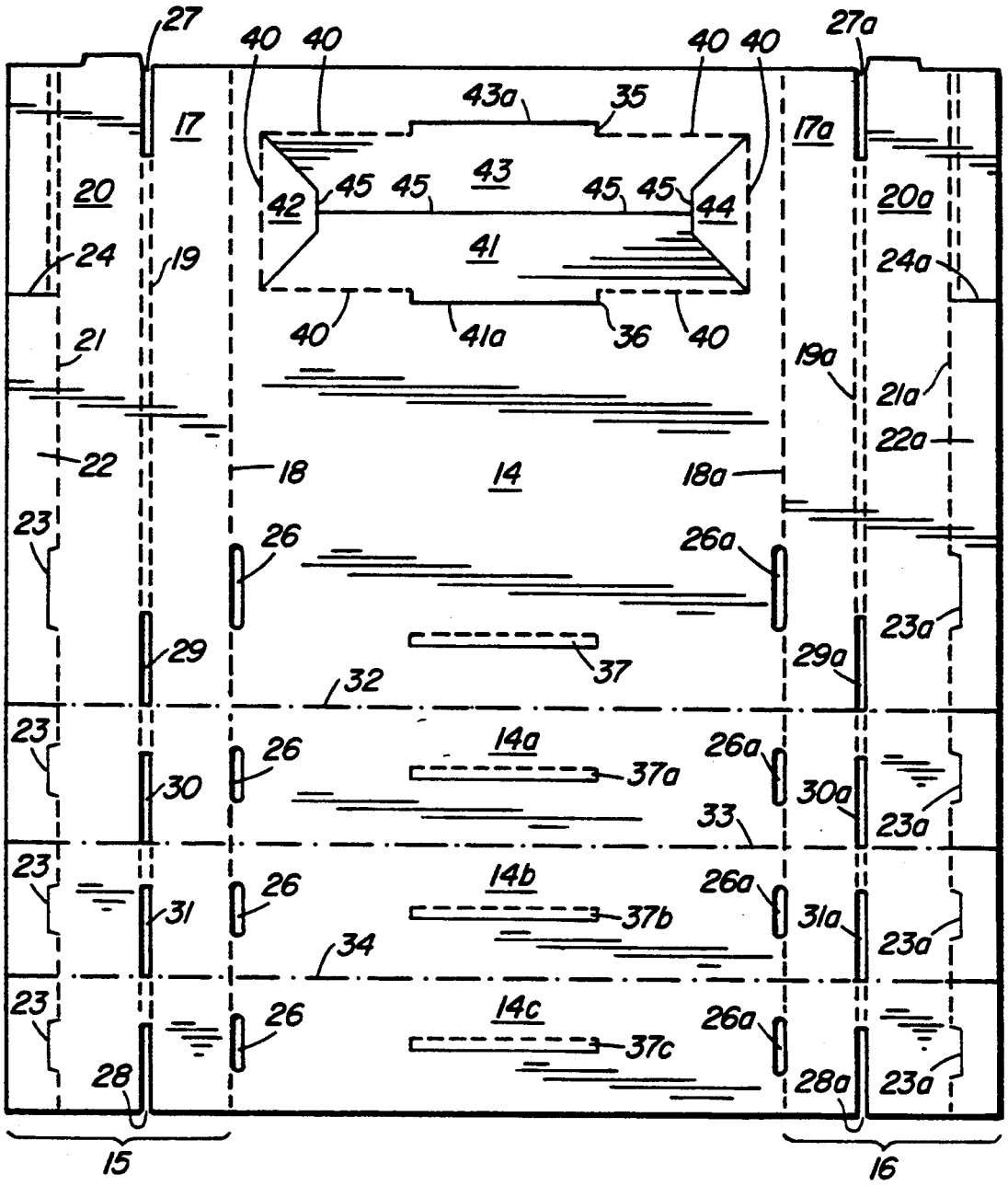
FIG. 4 is a representation of a blank sheet from which the top module of the table of the present invention is made.

The top module 10 is made of a single blank of corrugated cardboard. The structural features of the blank of cardboard are shown in FIG. 4. In an assembled state (FIG. 2), the top module 10 contains a top panel section 14 which is generally flat and planar. The top panel section is integral with downwardly dependent front flange section 15 and a rear flange section 16. The terms "front" and "rear" are used with reference to FIG. 1. The flange sections 15, 16 depend downwardly from the top section 14 and define therewith an inverted channel-shaped structure. Each flange section 15, 16 is formed of a panel set which is best indicated in FIG. 4. The front flange section 15 is comprised of an exterior panel section 17 which is hinged along a first side fold line 18 to one side of the panel 14.

The outer edge of the exterior panel section 17 is limited by a second side fold line 19 which is parallel with the first side fold line 18. The second side fold line 19 is indicated with a double broken line to indicate that this is a double fold line which provides a 180° hinged securement of panel section 17 to a rectangular support section or panel 20. The outer end of panel 20, in turn, is hinged at an auxiliary fold line 21 to an outer flap 22. The outer flap 22 is separated from the support section 20 by a full cut at each of a plurality of outwardly projecting first locking tabs 23. Another full cut 24 separates an uppermost portion of the flap 22 from the rest of the flap 22. Each of the first locking tabs 23 is compatible with an associated locking cutout 26. The locking cutouts 26 are made in the top panel section 14 and are generally coincident with the first side fold line 18.

There is a short slot 27 at the first end of the panel 14 and a similar short slot 28 is provided at the opposed end thereof. Additional slots 29, 30 and 31 are provided at predetermined intervals along the line of slots 28, 27 which coincides with the second side fold line 19.

Since the arrangement of the rear flange section 16 is identical to and a mirror image of the front flange section 15, the corresponding parts of the flange section 16 are referred to with the same reference numeral indexed with "a". Thus, there is a rear exterior panel section **17*a*, a rear first fold line 18*a*, a second side fold line 19*a*, a second support section 20*a*, and auxiliary fold line 21*a*, an outer flap 22*a*, a series of first locking tabs 23*a*, a full cut 24*a*, an uppermost section 25*a* of the outer flap 22*a*, a series of locking cutouts 26*a* and additional end slots 27*a*–31*a*, all shown in FIG. 4**.

A plurality of transverse tear lines 32, 33 and 34 extends across the entire blank through the front flange sections 15, top panel section 14 and rear flange section 16. The tear lines 32, 33 and 34 define between them and between the lower edge of the blank as shown in FIG. 4 three narrow strips 14*a*, 14*b* and 14*c* which can be torn off the blank when desired to thus selectively adjust the width of the table. It can be observed that when, for instance, the lowermost section 14*c* is torn off along line 34, the slits 31 and 31*a* become end slits replacing in their function (to be described later) the originally present slits 28, 28*a*.

The slits 27, 28, 29, 30 and 31 and their counterparts on the opposite side of the blank of FIG. 4 have the length which generally corresponds to the width of a flange section of an associated leg module which will be described later.

A transversely elongated holding cutout is provided by a channel-shaped full cut 35 disposed near the top end of the blank of FIG. 4 and a similar cutout is provided by another channel-shaped cut 36 below.

The subsections 14*a*, 14*b* and 14*c* contain each a corresponding cutout 37*a*, 37*b*, 37*c* and one additional cutout 37 is provided in the upper part of the panel section 14.

A rectangular fold line 40 secures four flaps 41, 42, 43 and 44 to the top panel section 14. Since the flaps 41–44 are separated from each other by a cut line 45 having the shape of a flattened letter H, downward push at the area of the fold line 40 bends the flaps 41–44 down and thus provides a rectangular opening in the top panel section 14.

Figure 5:
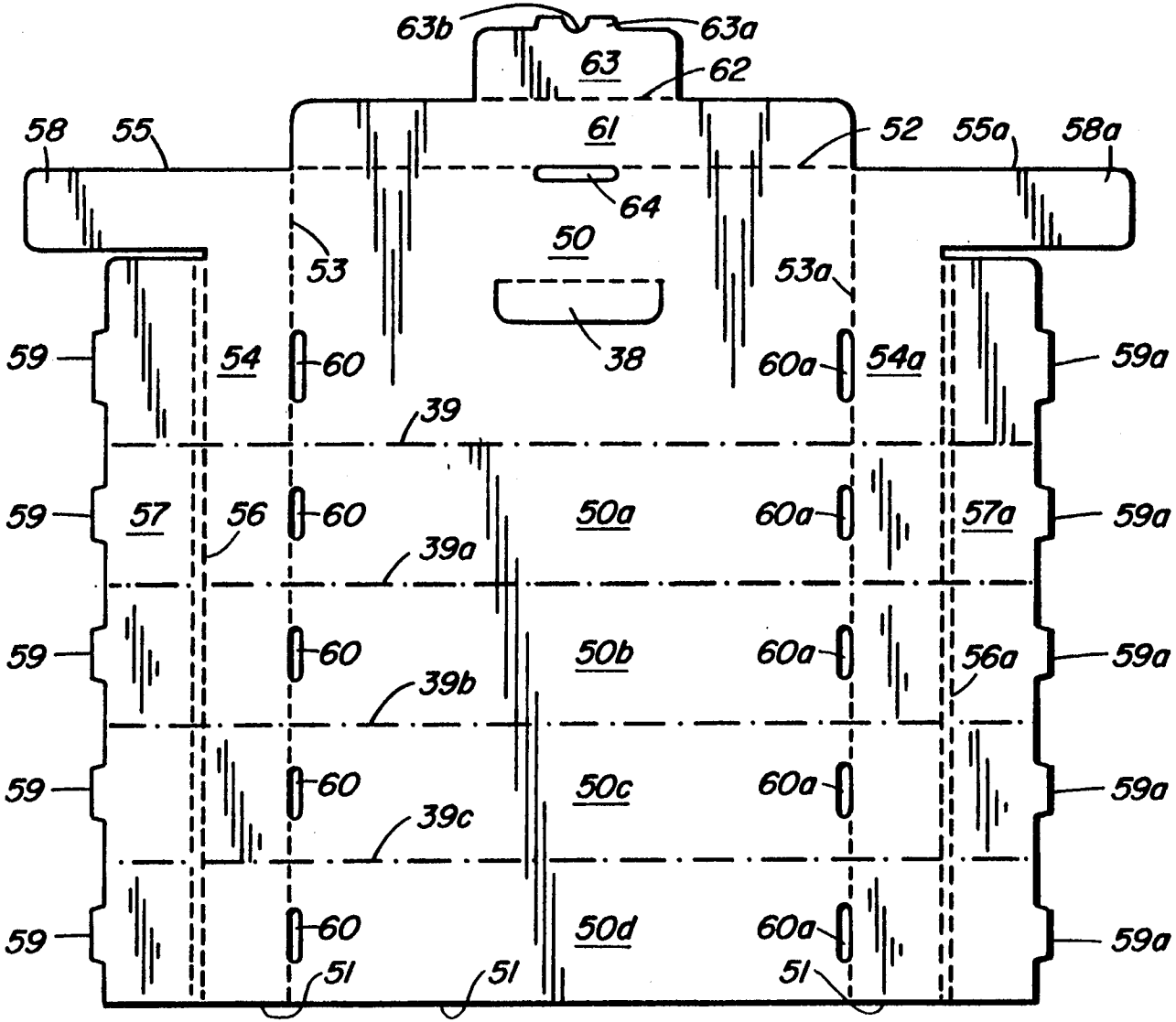
FIG. 5 is a representation of a blank from which each of the two leg modules of the table is made.

Turning now to representation in FIG. 5, the blank for producing one of the leg modules 12 or 13 includes a centrally disposed rectangular side panel section 50. Reference number 38 designates a U-cut and a fold line producing a handle hole. The panel section 50 is limited by a lower end edge 51, by an upper fold line 52, and by two opposed first side fold lines 53 and 53*a*. The first side fold line 53, 53*a* hingedly secures to the side panel section 50 a respective outer ridge panel section 54, 54*a*. The lower end of each of the panel sections 54, 54*a* is limited by the edge 51 and the upper end edge 55, 55*a* thereof (both coextensive with the upper fold line 52) limit the upper end of the outer ridge panel sections 54, 54*a*. A second side double fold line 56, 56*a* hingedly secures to the outer ridge panel section 54, 54*a* the respective ridge support panel 57, 57*a*.

An upper tongue section 58, 58*a* projects transversely outwardly from and is integral with the outer ridge panel section 54, 54*a*.

A plurality of first locking tabs 59, 59*a* is disposed along an outer edge portion of each of the ridge support panels 57, 57*a*. A series of first locking cutouts 60, 60*a* is disposed along the respective first side fold lines 53, 53*a*, the cutouts 60, 60*a* being provided in the side panel section 50. The width of the outer ridge panels 54, 54*a* and that of the support panels 57, 57*a* is generally identical so that when the two panels 57, 54 are folded upon each other and pivoted about the first side fold line 53, 53*a*, the respective locking tabs 59, 59*a* enter the locking cutouts 60, 60*a*. A plurality, in the example shown four, transverse tear lines 39, 39*a*, 39*b* and 39*c* subdivide the lower part of the side panel section 50 into four transverse strips 50*a*, 50*b*, 50*c* and 50*d*.

The upper fold line 52 separates the side panel section 50 from an attachment device of the leg module which serves the purpose of securing the leg module to the top module as will be described later. The attachment device includes an overlap panel 61 hinged to the panel 50 at the fold line 52. The overlap panel 61, in turn, is hinged, at an exterior fold line 62, to a hold flap 63 the width of which corresponds to the length of any of the holding cutouts 37–37*c* referred to above. A second locking tab 63*a*, provided with a finger recess 63*b*, is compatible with a second locking cutout 64 extending along the upper fold line 52 and provided in the side panel section 50. Thus, when the hold flap 63 passes through the respective cutout 37–37*c* and is folded about the fold line 52 and tucked under the panel 14 of the top module, to a position perpendicular to the side panel section 50, the second locking tab 63 enters the second locking cutout 64. This step, which will be later described, is effected such that the overlap panel 61 actually overlaps the respective end portion of the top panel section 14.

As in the case of tear lines 34, 33 and 32, the tear lines 39–39*c* allow the tearing off of the respective sections 50*d*, 50*c*, 50*b* or 50*a* from the leg module to selectively shorten the height of the top of the table.

Figure 6:
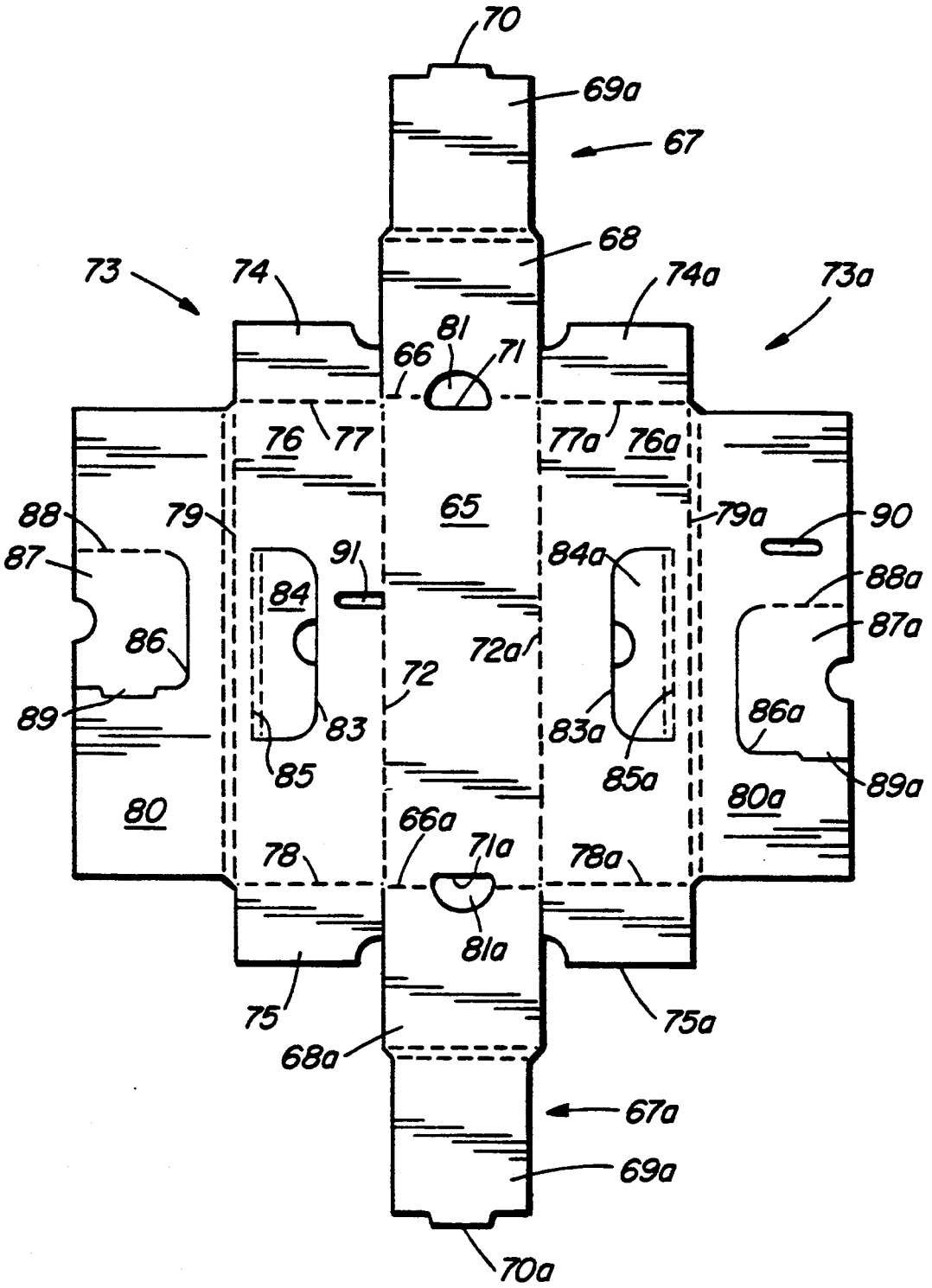
FIG. 6 is a representation of a blank for use in assembling a utensil box which can be used, if desired, with the table of the present invention.

Reference may now be had to FIG. 6 which shows a preferred embodiment of an optional blank used in providing a utensil tray for the folding table of the present invention. Reference numeral 65 designates a rectangular bottom panel of the tray. It is connected, by means of end fold lines 66, 66*a*, one at each end, to the respective end panel 67, 67*a*. Each end panel 67, 67*a* is comprised of an outer end panel section 68, 68*a* and of an inner end panel section 69, 69*a*. The free end edge of each inner end panel section 69, 69*a* is provided with a locking tab 70, 70*a*, lockingly compatible with a locking cutout 71, 71*a* made in the bottom panel 65 in coincidence with the end fold line 66, 66*a*. Each locking cutout 71, 71*a* is defined by the longest part of a D-shaped recess 81, 81*a*. Two opposed side fold lines 72, 72*a* connect hingedly the bottom 65 with two opposed side panels 73, 73*a*. Each side panel 73, 73*a* is comprised of a pair of first and second end flaps 74, 75, 74*a*, 75*a* which are hinged to the respective outer side panel section 76, 76*a* at fold lines 77, 78, 77*a*, 78*a*. An outer side double fold line 79, 79*a*, separates the respective outer side panel section 76, 76*a* from the inner side panel section 80, 80*a*.

Each outer side panel section 76, 76*a* is provided with a U-shaped cut line 83, 83*a* which releases a support flap 84, 84*a* for a sideways/outward displacement about a hinge double line 85, 85*a* (such that the panel section 76, 76*a* is parallel with the side wall of the tray), for the purpose of holding the container in the top of the table as will be described.

Each inner side panel section 80, 80*a* includes an angled cut line 86, 86*a* which releases a respective partition panel 87, 87*a* for a pivotal movement about a hinge line 88, 88*a*. The free end portion of each panel 87, 87*a* remote from the respective hinge line 88, 88*a* is provided with a locking tab 89, 89*a* adapted, on folding of the tray, to enter the respective locking cutouts 90, 91 made in the inner side panel section 80*a* and in the outer side panel section 76, respectively. Thus on folding of the tray, the two partitions 87, 87*a* can be pivoted to span the space across the tray and to become locked in their position to subdivide the inside rectangular space of the tray.

Referring now to the representation of FIG. 4, in assembling the table, the blank of FIG. 4 is first folded about the fold lines 18, 18*a* such as to raise the front and rear flange sections 15, 16. In the next step, the support sections 20, 20*a* are folded inwards and back onto the raised exterior panel section 17, 17*a*. The locking tabs 23 are pressed into the respective locking cutouts from beneath the top panel section 14, while the outer flaps 22, 22*a* yield into a position generally coplanar with the panel 14 (see FIG. 2). With such assembly having been made, the top module assumes the configuration of a channel shaped board member, produced, in the embodiment shown, from corrugated board, which has downwardly dependent front and rear flange sections 15, 16. Each flange section 15 and 16 also defines, by virtue of the folding over of the support sections 20, 20*a*, a passage. At this stage, the top module 10 is ready for assembly with the first and second leg modules 11, 12. The assembly of leg module 12 shown in FIG. 2 will now be explained with reference to FIG. 5 and also FIG. 3. The top module, the outer ridge panel sections 54, 54*a* are each folded down from the plane of FIG. 5, along the respective first side fold line 53, 53*a*.

Since the second fold line 56 is a double fold line, similar to the double fold lines 19, 19*a* (in FIG. 4), it allows the folding of the support panels 57, 57*a* inwards and onto the respective outer ridge panel section 54, 54*a* and a subsequent pressing of the locking tabs 59, 59*a* into the respective first locking cutouts 60, 60*a*. Since the tongues 58, 58*a* are integral and coplanar with the outer ridge panel sections 54, 54*a*, they now project at right angles to the plane of the side panel section 50. The assembled leg module is now a channel-shaped section.

The overlap panel 61 is bent down along the upper fold line 52. The tongues 58 are inserted into the passages formed between the exterior panel sections 17, 17*a* and the support sections 20, 20*a*. The tongues 58, 58*a* are inserted all the way until the side panel section 50 abuts against the edge of the top panel section 14. This is permitted by virtue of providing the end slits 28, 28*a* (or 27, 27*a*) such that the entire width of the outer ridge panel sections 54, 54*a* is accommodated in the respective end slit 28, 28*a*.

Figures 2, 3:
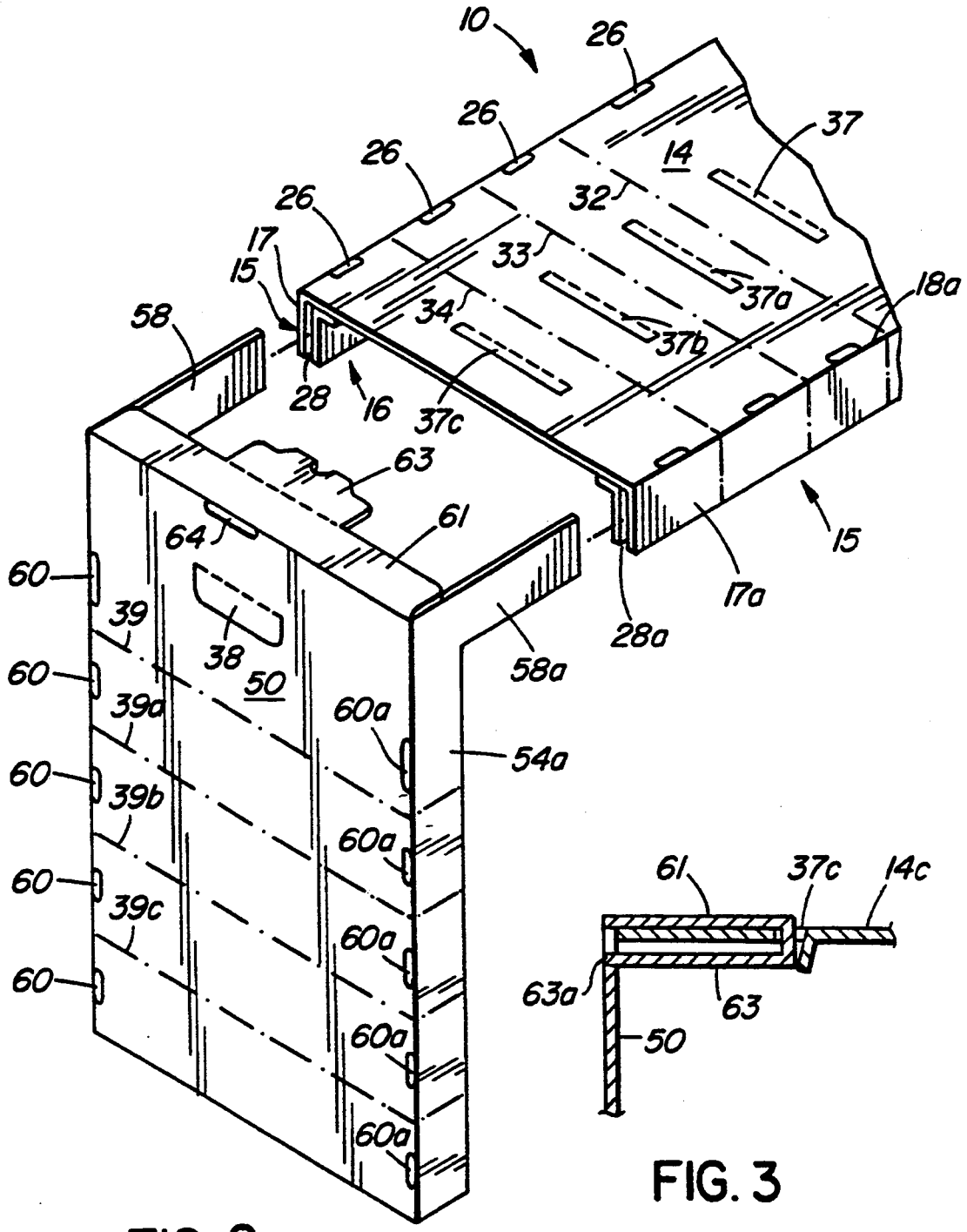
FIG. 2 is an exploded view of one end of the table as shown in FIG. 1.
FIG. 3 is a partial sectional view taken along section line III—III of FIG. 1.

The overlap panel 61 is placed on top of the top panel section 14 and the holding flap 63 inserted into the slot 36 and wrapped under the panel 14 about the exterior fold line 62. With the holding flap tucked under by reaching inside through the handle hole 38, the second locking tab 63*a* enters the second locking cutout 64 thus firmly holding the leg module connected with the top module. The assembled state of the elements shown in FIG. 2 is shown diagrammatically in FIG. 3 with respect to the holding flap 63 and its associated sections.

When it is desired to remove the leg module 12 from the top module 10, the operation is reversed. Through the handle hole 38, fingers are inserted to press on the panel 50 near the top. The locking tab 63*a* is thus released from the second locking cutout 64. Then the holding flap 63 is pulled out of the holding cutout 37 whereupon the leg module 12 (or its tongues 58, 58*a*) can be withdrawn from engagement with the passages 37*c* provided in the downwardly directed flanges of the top module as shown in FIG. 3.

The assembly and disassembly at the opposite side of the top module 10 is identical. It is should be noted, however, that the holding cutout 35 which is disposed on the edge of the fold line 40 is slightly wider to accommodate not only the holding flap 63 of the respective leg module but also the support flap 84 or 84*a* as will be described hereafter.

Reference should now be had to the arrangement of FIG. 6. The assembly of the blank of FIG. 6 is effected as follows:

First, the outer side panel sections 76, 76*a* are raised up from the plane of FIG. 6, about the side fold line 72, 72*a*. The next step in assembling the rectangular tray is the folding over of the inner side panel sections 80, 80*a* into the box. The end flaps 74, 74*a* and 75, 75*a* are then turned inwardly. The outer end panel sections 68 and 68*a* are raised upwards from the plane of FIG. 6 and the respective inner end panel sections 69, 69*a* folded down into the box over the respective end flaps 74, 75, 74*a*, 75*a* until the respective locking tabs 70, 70*a* enter the associated locking cutouts 71, 71*a*. With the tray thus assembled, the edges of the inner panels sections 69, 69*a* abut against the inner surfaces of the inner side panel sections 80, 80*a* near the bottom of the tray and thus hold them in place by friction. There is provided a support flap 84, 84*a* in each of the outer side panel sections. The support flap 84 can be moved outwards and due to the double hinged line 85, the support flaps 84, 84*a*, now parallel but slightly outwardly spaced each from its respective outer side panel section 76, 76*a* can be inserted into the slots provided, on turning the flaps 41, 43 in the top panel section 14. This is normally done (FIG. 1) by pushing the assembled box made from the blank of FIG. 6 into the opening provided by the fold line 40 with the result that the flaps 41, 42, 43 and 44 become bent downwardly opening the rectangular opening in the panel 14. The support flaps 84, 84*a* eventually rest with the part defined by the two fold lines of the hinge 85, 85*a*, on the edge 43*a*, 41*a* of the flaps 43, 41 coincident with the respective slot 35, 36. The opening now surrounds the tray and slightly presses the side walls 76+80 and 76*a*+80*a* of the tray inwards to increase the frictional engagement between the edges of the inner end panel sections 69, 69*a* and the surface of the inner side panel sections 80, 80*a*.

If desired, the partition panels 87, 87*a* may be each turned inwardly to engage the opposite inner wall locking tab 89 with the locking aperture 90, while the locking tab 89*a* can be engaged with the locking aperture 91.

The withdrawal of the box from the top of the table is a simple operation which would typically precede the disassembling of the table. The tray itself is easy to disassemble by slightly pressing on the tray bottom panel 65 near each fold line 66, 66*a* to release the respective tab 70, 70*a* from the locking cutout while pressing from outside, through the respective D-shaped recess 81, 81*a* to release the end panel sections 69, 69*a* whereupon the unfolding is an easy task of just spreading the panels back into a planar blank shape. If the table is to be used in a place where the width of the table should be narrowed, the outermost one or more subpanels 14*c* or 14*b* or even 14*a* can be torn off each along the respective tear line 34, 33 or 32. Similarly, the height of the table can be adjusted by tearing off the desired number of the bottom sub panels 50*a*–50*c*.

Those skilled in the art will readily appreciate that many mechanical equivalents and modifications of the structure of the folding table of the present invention can be made without departing from the spirit of the present invention. Just as one of many examples, the securement of the leg modules to the top modules can be made in a reversed fashion with the tongues projecting from the top module into the leg modules. The auxiliary box may be omitted entirely. The structural arrangement of the box itself can also vary widely from what is shown in the disclosure. Accordingly, I wish to protect by Letters Patent which may issue on the present application all such embodiments as properly and fairly fall within the scope of my contribution to the art.

I claim:

1. A folding table made from sheet material such as paperboard and comprising, in combination:

(a) a transversely extending inverted channel shaped top module comprised of a flat top panel section, a front flange section and an opposed rear flange section, said flange sections depending downwardly from the top section at the front and rear edges thereof, respectively;

(b) each flange section defining, at each end of the top section, a transversely extending passage;

(c) an upright leg module at each side of the top section;

(d) each leg module being channel shaped and comprising a flat side panel section, a front ridge section and an opposed rear ridge section, said ridge sections projecting each inwardly from a respective front or rear end of the side panel section;

(e) each leg module further including a pair of tongues, each tongue being generally coplanar and integral with a respective one of the ridge sections, being located at an upper end section of each of said ridge sections and extending at right angles to the respective side panel section, each tongue being snugly received in a respective one of said transversely extending passages;

(f) the top panel section including, near one side thereof, a plurality of spaced apart tear lines parallel with one another and with said one side of the table, said tear lines being adapted to allow tearing off a part of the top section to thus selectively reduce the width thereof;

(g) said transversely extending passages at said one side of the table extending over a region of said tear lines;

whereby the tongues maintain the leg modules generally at right angles with respect to the top section and define therewith a rectangular free space limited by edges of the flanges and ridges, respectively, of the top module and of the leg modules, and the tongues of the respective leg section are fully receivable in the respective passages regardless of the instant width of the table.

2. The table as claimed in claim 1, wherein each leg section includes, near a lower end thereof, a plurality of spaced apart tear lines parallel with one another and with a lower edge of the leg section, said tear lines being adapted to allow tearing off an end part of the respective leg section to thus selectively reduce the height of the table.

3. For use in making the top module of the table of claim 1, an integral blank, comprising, in combination:

(a) a rectangular top panel section defined by two opposed end edges and two opposed first side fold lines;

(b) a pair of opposed rectangular exterior flange sections, each hinged to the top panel section at the respective first side fold line;

(c) a pair of opposed, rectangular support sections, each support section hinged to the respective one of said exterior flange sections along a second fold line parallel with the first fold line;

(d) a plurality of first locking tabs extending transversely away from an outer margin of each support section;

(e) a plurality of first locking cutouts in said top panel section, said first locking cutouts being compatible with said first locking tabs and being disposed along and in general coincidence with the respective first fold line;

(d) said exterior flange sections and said support sections being of a generally identical width whereby, on assembly, they define a slot-shaped passage therebetween; and (e) a plurality of transverse tear lines extending across the entire blank from one side thereof to the other.

4. The blank of claim 3, wherein there is a slit at each end of each of the second fold lines, the length of the slit generally corresponding to the width of a flange section of an associated leg module.

5. The blank of claim 4, further comprising at least two opposed, transversely elongated holding cutouts disposed in the top panel section, one near each end thereof.

6. The blank of claim 5, wherein said transverse tear lines subdivide the blank into a plurality of transverse strips, each strip comprising at least one of said locking cutouts at each side of the blank, and at least one holding cutout.

7. The blank of claim 6, further comprising a rectangular cutout in the top panel section and adapted to receive a compatible rectangular container *76a*, said rectangular cutout being provided along and at a close spacing from one of the sides of the top panel section.

8. For use in making one of the modules of the table of claim 1, an integral blank, comprising, in combination:

(a) a centrally disposed, rectangular side panel section limited by a lower end edge, an upper fold line and two opposed first side fold lines;

(b) a first and second outer ridge panel section extending one along each side of the side panel section and limited each by a lower end edge coincident with said lower end edge of the side panel, by an upper end edge coextensive with said upper fold line, by the respective first side fold line, and by an opposed second side fold line, said fold lines being parallel with each other;

(c) a first and second ridge support panel hinged one to each of said ridge panel section at the respective second side fold line;

(d) an upper tongue section projecting transversely outwardly from and integral with each of said outer ridge panel sections;

(e) a plurality of first locking tabs disposed along an outer edge portion of each of the ridge support panels;

(f) a plurality of first locking cutouts in said side panel section, said first locking cutouts being compatible with said first locking tabs and being disposed along and in general coincidence with the respective first fold line;

(g) a plurality of transverse tear lines extending across the entire blank from one side thereof to the other; and (h) attachment device at said upper fold line for securement of the leg module made from the blank to a respective top module.

9. The blank of claim 8, wherein the attachment device includes a rectangular overlap panel hinged to the side panel section at said upper fold line, and a hold flap hinged to the overlap panel at an exterior fold line, said hold flap including a second locking tab compatible with a second locking cutout located in said side panel section in general coincidence with said upper fold line.

10. The tab of claim 8, wherein the transverse tear lines subdivide the blank into a plurality of transverse strips, each transverse strip including at least two said first locking tabs, one at each side of the blank, and at least two said first locking tabs, one at each first side fold line.

11. A collapsible, portable table made from sheet material such as paperboard and comprising, in combination:

(a) a transversely extending inverted channel shaped top module comprised of a flat top panel section, a front flange section and an opposed rear flange section, said flange sections depending downwardly from the top section at the front and rear ends thereof, respectively;

(b) each flange section defining a slot-shaped passage coextensive with the respective flange section;

(c) an upright leg module at each side of the top section;

(d) each leg module being channel shaped and comprising a flat side panel section, a front ridge section and an opposed rear ridge section, said ridge sections projecting each inwardly from a respective front or rear end of the side panel section;

(e) a pair of tongues at each side of the top module, each pair including a front tongue and a rear tongue;

(f) the front tongue of each pair being generally coplanar and integral with the respective front flange or ridge section and being non-integral with the respective front ridge or flange section;

(g) the rear tongue of each pair being generally coplanar and integral with the respective rear flange section or ridge section and being non-integral with the respective rear ridge or flange section;

(h) each tongue extending at right angles to the panel section of that module with which the tongues of the respective pair are integral;

(i) each tongue being snugly received in a passage provided in an adjacent end portion of the respective flange section or ridge section of that module with which the respective tongue is non-integral;

(j) the top panel section and both said flange sections including, near one side of the top module, a plurality of spaced apart top tear line systems, each top tear line system including tear lines extending across the top panel section and across both flange sections, each tear line system defining a tear plane generally parallel with the side panel section, each top tear line system being adapted to allow tearing off a part of the top section to thus selectively reduce the width thereof;

(k) said transversely extending passages at said one side of the table extending over a region of said tear lines;

whereby the tongues maintain the leg modules generally at right angles with respect to the top section and define therewith a rectangular free space limited by edges of the flanges and ridges, respectively, of the top module and of the leg modules, and the tongues of the respective leg section are fully receivable in the respective passages regardless of the instant width of the table.

12. A collapsible, portable table made from sheet material such as paperboard and comprising, in combination:

(a) a transversely extending inverted channel shaped top module comprised of a flat top panel section, a front flange section and an opposed rear flange section, said flange sections depending downwardly from the top section at the front and rear ends thereof, respectively;

(b) each flange section defining a slot-shaped passage coextensive with the respective flange section;

(c) an upright leg module at each side of the top section;

(d) each leg module being channel shaped and comprising a flat side panel section, a front ridge section and an opposed rear ridge section, said ridge sections projecting each inwardly from a respective front or rear end of the side panel section;

(e) a pair of tongues at each side of the top module, each pair including a front tongue and a rear tongue;

(f) the front tongue of each pair being generally coplanar and integral with the respective front flange or ridge section and being non-integral with the respective front ridge or flange section;

(g) the rear tongue of each pair being generally coplanar and integral with the respective rear flange section or ridge section and being non-integral with the respective rear ridge or flange section;

(h) each tongue extending at right angles to the panel section of that module with which the tongues of the respective pair are integral;

(i) each tongue being snugly received in a passage provided in an adjacent end portion of the respective flange section or ridge section of that module with which the respective tongue is non-integral;

(j) each leg module comprises a plurality of leg tear line systems, each leg tear line system comprising a tear line in the respective side panel section and two adjoining tear lines, one in each respective ridge section, said leg tear line systems being located near a lower end of the respective leg module, each leg tear line system defining a leg tear plane generally parallel with the top panel section each tear line system being adapted to allow tearing off a part of the leg module to thus selectively reduce the height thereof;

whereby the tongues maintain the leg modules generally at right angles with respect to the top section and define therewith a rectangular free space limited by edges of the flanges and ridges, respectively, of the top module and of the leg modules.

* * * * *